US005184932A

United States Patent [19]

Misuda et al.

[11] Patent Number: 5,184,932

[45] Date of Patent: Feb. 9, 1993

[54] LINKAGE MECHANISM OF A WORK IMPLEMENT

[75] Inventors: Kenji Misuda; Norihito Bando, both of Kawagoe, Japan

[73] Assignees: Kabushiki Kaisha Komatsu Seisakusho; Komatsu Mec Corp., both of Tokyo, Japan

[21] Appl. No.: 794,850

[22] Filed: Nov. 21, 1991

Related U.S. Application Data

[63] Continuation of Ser. No. 490,594, Jul. 16, 1990, abandoned.

[30] Foreign Application Priority Data

Sep. 19, 1988 [JP] Japan ..... 63-232641

[51] Int. Cl.[5] ..... E02F 3/28

[52] U.S. Cl. ..... 414/685; 414/700

[58] Field of Search ..... 414/685, 694, 695.5, 414/700, 718, 728

[56] References Cited

U.S. PATENT DOCUMENTS 4,154,349 5/1979 Christensen ..... 414/685 X

FOREIGN PATENT DOCUMENTS 51-9767 3/1976 Japan .

54-39643 11/1979 Japan .

62-163557 10/1987 Japan .

*Primary Examiner*—Michael S. Huppert

*Assistant Examiner*—Donald W. Underwood

*Attorney, Agent, or Firm*—Armstrong, Westerman, Hattori, McLeland & Naughton

[57] ABSTRACT

A linkage mechanism of a work implement installed in a loading vehicle such as a shovel-loader or the like, which is adapted to vertically move a bucket as held in a horizontal state without operating tilt-cylinder, while preserving the function of the Z-bar linkage in the prior art; in which linkage mechanism, when the distance from a pivotable support point (A) between a bucket (3) and a lift arm (1) to a pivotable support point (B) between the lift arm (1) and a bellcrank (5) is represented by (X) and the distance from the above-mentioned pivotable support point (B) to a pivotable support point (O) between the lift arm (1) and a vehicle body (9) is represented by (Y), they are preset so as to fulfil $Y/X=\alpha$, and also, first and second triangles (ΔABC, ΔOBE) formed by the liftarm (1) and the bellcrank (5) on the vehicle body side and on the bucket side, as well as a third triangle (ΔADC) formed by a tilt rod (6) and the bucket (3) and a fourth triangle (ΔOFE) formed by a tilt cylinder and the vehicle body (9) are preset so as to respectively fulfil a mutually similar figure relation.

2 Claims, 4 Drawing Sheets

LINKAGE MECHANISM OF A WORK IMPLEMENT

This application is a continuation of application Ser. No. 490,594 filed Jul. 16, 1990, abandoned.

FIELD OF THE INVENTION

The present invention relates to a linkage mechanism for a work implement that is available in a loading vehicle such as a shovel-loader or the like. More particularly, the present invention relates to a linkage mechanism of a work implement in which improvements are made in the attitude of a bucket connected so as to be able to tilt better forward and backward to the tip end of a lift arm. The base end of the lift arm is pivotably supported from a vehicle body and which can rotate up and down about the aforementioned pivotable support point.

BACKGROUND OF THE INVENTION

In FIG. 1 is shown a side view of a work implement in a heretofore known shovel-loader. In this figure, a lift arm d pivotably supported at a pivotal support section i of the lift arm on the side of a vehicle body a in an upwardly and downwardly rotatable manner, rotates upwards when a lift cylinder e extends, and a bucket c pivotably supported in a forwardly and backwardly tiltable manner at a bucket pivotable support section j at the tip end of the lift arm d, is tilted backwardly via a bellcrank f and a tilt rod h when a tilt cylinder is extended. Reference character b designates a tire. The state of the bucket shown at c in this figure is a state upon excavation of earth and sand, and a bucket bottom surface k is nearly parallel to a ground surface GL (horizontal). And, a vehible body connecting pivotable support section of the tilt cylinder g is designated by reference character l, a connecting pivotable support section on the side of the bellcrank f by character m, a connecting pivotable support section to the lift arm d of the bellcrank f by character n, a connecting pivotable support section between the bellcrank f and the tilt rod h by character p, a connecting pivotable support section between the tilt rod h and the bucket c by character g, a connecting pivotable support section on the side of the vehicle body of the lift cylinder e by character r, and a connecting pivotable support section on the side of the lift and d thereof by character s.

Thus, after excavation has been finished, a loading work starts, and when the lift cylinder e and the tilt cylinder g are extended in a desired manner, the bucket becomes the state shown at $c_1$. If the centers of the above-described respective pivotable support sections when the bucket has moved from c to $c_1$ are represented by movements of reference characters for simplicity of explanation, they are indicated by $s \rightarrow s_1$, $j \rightarrow j_1$, $m \rightarrow m_1$, $n \rightarrow n_1$, $p \rightarrow p_1$, $q \rightarrow q_1$ and $k \rightarrow k_1$.

Then, if the lift and d is further rotated upwards by operating the lift cylinder e and the bucket pivotable support section j is raised up to the highest position $j_2$, the bucket comes to a position $c_2$, and the respective pivotable support sections would come respectively to the positions designated by the same characters but having a suffix 2 (for instance, $m \rightarrow m_2$). Under this condition, if the tilt cylinder g is contracted in order to forwardly tilt the bucket, the respective pivotable support sections would come respectively to the positions designated by the same characters but having a suffix 3 (for instance, $m_2 \rightarrow m_3$, but the positions of the sections $n_2$, $s_2$ and $j_2$ would not change), and the bucket takes the state shown at $c_3$.

This linkage mechanism in the prior art shown in FIG. 1 is a linkage generally called "Z-bar linkage", in which when the bucket takes the state shown at c in FIG. 1, if the tilt cylinder g is extended, the bucket bottom surface k would rotate in the direction shown by an arrow K, and at this time a hydraulic pressure in the bottom side pressure receiving chamber gb of the tilt cylinder g acts, and therefore, this linkage is that generally used in a loading vehicle which necessitates a large excavation force.

Though this linkage is designed so as to maintain a backwardly tilted state (designed for reducing tilt angle variations under a tilted state) so that loaded articles may not spill out even if the lift arm is rotated up and donw with the bucket held backwardly tilted (the state shown at $c_1$ in FIG. 1) because it is mainly used for loading of earth and sand, it does not have a structure for eliminating tilt angle variations under a horizontal state of the bucket.

More particularly, one example of the operation when the bucket is held in parallel to the ground surface (held horizontal) as shown at c in FIG. 1 and the lift arm d is rotated upwards with the length of the tilt cylinder g at that time (the distance between l and m in that figure) maintained, is shown by a dash-line R in FIG. 4, in which at a certain instance at tilt angle $\theta$ with respect to the ground of the bucket bottom surface k changes by about 20°.

Consequently, in order to maintain a horizontal state of the bucket, upon rotating the lift arm the operation of extending and/or contracting the tilt cylinder is necessitated, and thus there was a disadvantage that the operation is troublesome and also a maneuverability was poor.

SUMMARY OF THE INVENTION

The present invention has been worked out in view of the above-described circumstance of the art, and one object of the invention is to provide a linkage mechanism of a work implement which preserves the functions of the Z-bar linkage in the prior art, and yet which can vertically move a bucket while maintaining it at a horizontal state without operating a tilt cylinder.

In order to achieve the above-mentioned object, according to one feature of the present invention, there is provided a linkage mechanism of a work implement in a loading vehicle such as a shovel-loader or the like, including a lift arm having one end pivotably supported from a vehicle body and the other end extended forwards and adapted to be rotated up and down in the vertical direction about the pivotable support point on one side, a forwardly and backwardly tiltable bucket having a lower portion of its rear surface pivotably supported from the front end portion of the above-mentioned lift arm, a bellcrank having its nearly middle portion in the lengthwise direction pivotably supported from the above-mentioned lift arm, a tilt rod pivotably connected between the lower side end portion of the aforementioned bellcrank and an upper portion of the rear surface of the above-mentioned bucket, and a tilt cylinder pivotably connected between the aforementioned vehicle body and the other end portion of the above-mentioned bellcrank to be operated for tilting the above-mentioned bucket; characterized in that in the case where the distance from the pivotable support point between the aforementioned bucket and the above-described lift arm to the pivotable support point between the aforementioned lift arm and the above-described bellcrank is represented by X, and the distance from the pivotable support point between the aforementioned lift arm and the above-mentioned bellcrank to the pivotable support point between the aforementioned lift arm and the above-described vehicle body is represented by Y, a ratio between these distances X and Y is set at $\propto$ ($Y/X=\alpha$), and that a triangle formed by connecting the pivotable support point of the aforementioned lift arm from the vehicle body, the pivotable support point of the aforementioned bellcrank from the lift arm and the pivotable support point of the aforementioned tilt cylinder from the bellcrank and a triangle formed by connecting the pivotable support point of the aforementioned bellcrank from the lift arm, the pivotable support point of the aforementioned lift arm from the bucket and the pivotable support point of the aforementioned tilt rod from the bellcrank, as well as a triangle formed by connecting the pivotable support point of the aforementioned lift arm from the vehicle body, the pivotable support point of the aforementioned tilt cylinder from the bellcrank and the pivotable support point of the aforementioned tilt cylinder from the vehicle body, and a triangle formed by connecting the pivotable support point of the aforementioned lift arm from the bucket, the pivotable support point of the aforementioned tilt rod from the bellcrank and the pivotable support point of the aforementioned tilt rod from the bucket, are respectively in a mutually similar figure relation.

The advantages of the present invention as featured above are as follows.

That is, since upon rotation of the lift arm, vertical movement at a horizontal attitude of the bucket becomes possible without extension nor contraction of the tilt cylinder while preserving the characteristic of the Z-bar linkage such that a hydraulic pressure in a bottom side pressure receiving chamber of a tilt cylinder is utilized upon excavation and that shock upon removal of earth with the boom held at a high position can be reduced, improvements in a versatility and a maneuvability can be realized.

The above-mentioned and other objects, features and advantages of the present invention will become apparent for those skilled in the art from the following description in which a preferred embodiment conformable to a principle of the present invention is disclosed as a practical example and the explanation taken in conjunction with the accompanying drawings.

DETAILED DESCRIPTION OF THE PREFERRED EMBODIMENT

In the following, one preferred embodiment of the present invention will be explained with reference to FIGS. 2 to 4 in the accompanying drawings.

Figure 1:
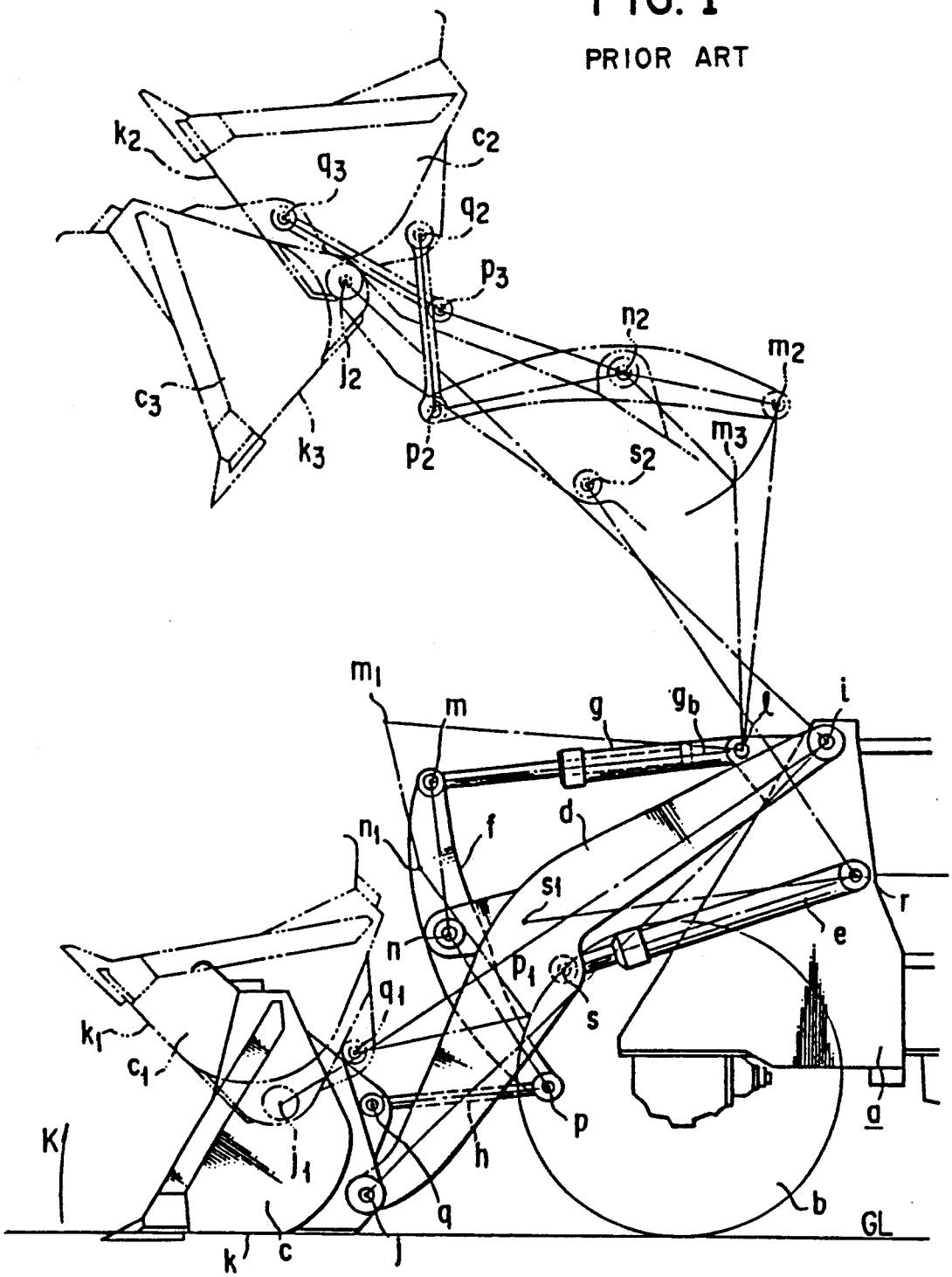
FIG. 1 PRIOR ART
FIG. 1 is a schematic side view for explaining operations relating to a work implement in a shovel-loader in the prior art.
Figure 2:
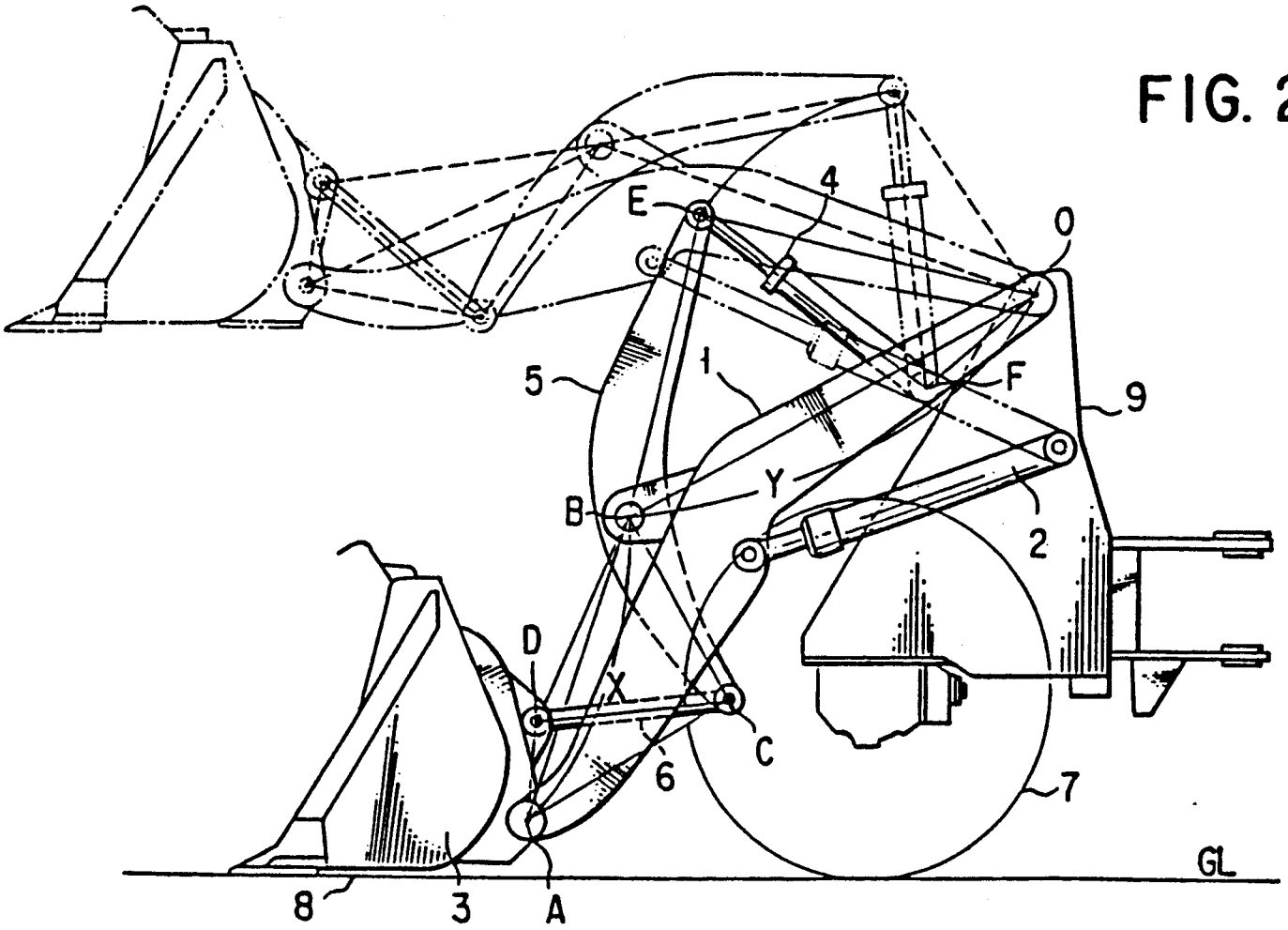
FIG. 2 is a schematic side view showing one preferred embodiment of the present invention.

FIG. 2 shows a side view of a work implement in a shovel-loader according to the present invention. In this figure, a lift arm 1 pivotably supported at a lift arm pivotable support portion O on the vehicle body side (in the following explanation and in FIGS. 3 and 4, for the purpose of simplicity, for a pivotable support portion and for its center is used a same reference symbol like in FIG. 2) in a vertically rotatable manner, would rotate upwards when a lift cylinder 2 extends, and a bucket 3 pivotably supported at a bucket pivotably support portion A at the tip end of the lift arm 1 in a forwardly and backwardly tiltable manner would be tilted backwards via a bellcrank 5 and a tilt rod 6 when a tilt cylinder 4 extends.

Reference numeral 7 designates a tire. Under the state of the bucket 3 shown by solid lines in FIG. 2, a bucket bottom surface 8 is parallel to the ground surface GL (horizontal). And a vertical body side connecting pivotable support portion of the tilt cylinder 4 is represented by reference character F, a bellcrank side connecting pivotable support portion thereof is represented by reference character E, a connecting pivotable support portion of the bellcrank 5 to the lift arm 1 is represetned by reference character B, a connecting pivotable support portion between the bellcrank 5 and the tilt rod 6 is represented by reference character C, and a connecting pivotable support portion between the tilt rod 6 and the bucket 3 is represented by reference character D.

In addition, in the case where the distance from a pivotable coupling portion A between the lift arm 1 and the bucket 3 to a pivotable coupling portion B between the lift arm 1 and the bellcrank 5 is represented by reference character X and the distance from the pivotable coupling portion B between the lift arm 1 and the bellcrank 5 to a pivotable coupling portion O between a vehicle body 9 and the lift arm 1 is represented by reference character Y, the ratio between these distances X and Y is set to be equal to $\propto$ ($Y/X=\alpha$), and so that the triangles formed on the side of the vehicle body 9 and on the side of the bucket 3 with respect to the pivotable coupling portion B between the bellcrank 5 and the lift arm 1 may become similar figures to each other, the following relations are established:

$\Delta ABC$ $\Delta OBE$ (similar figure ratio $\alpha$)
$\Delta ADC$ $\Delta OFE$ (similar figure ratio $\alpha$)

Next, explaining the operation, assuming now that the bucket 3 is placed with the bucket bottom surface 8 put on the ground surface GL as shown by solid lines in FIG. 2, then even if the lift arm 1 is rotated upwards without operating the tilt cylinder 4, the relations of $\Delta ABC$ $\Delta OBE$ and $\Delta ADC$ $\Delta OFE$ would be always established.

Accordingly, the bucket 3 would rotate while holding the above-mentioned attitude with respect to the line of the ground surface GL, and the bucket would be always held horizontal.

Figure 3:
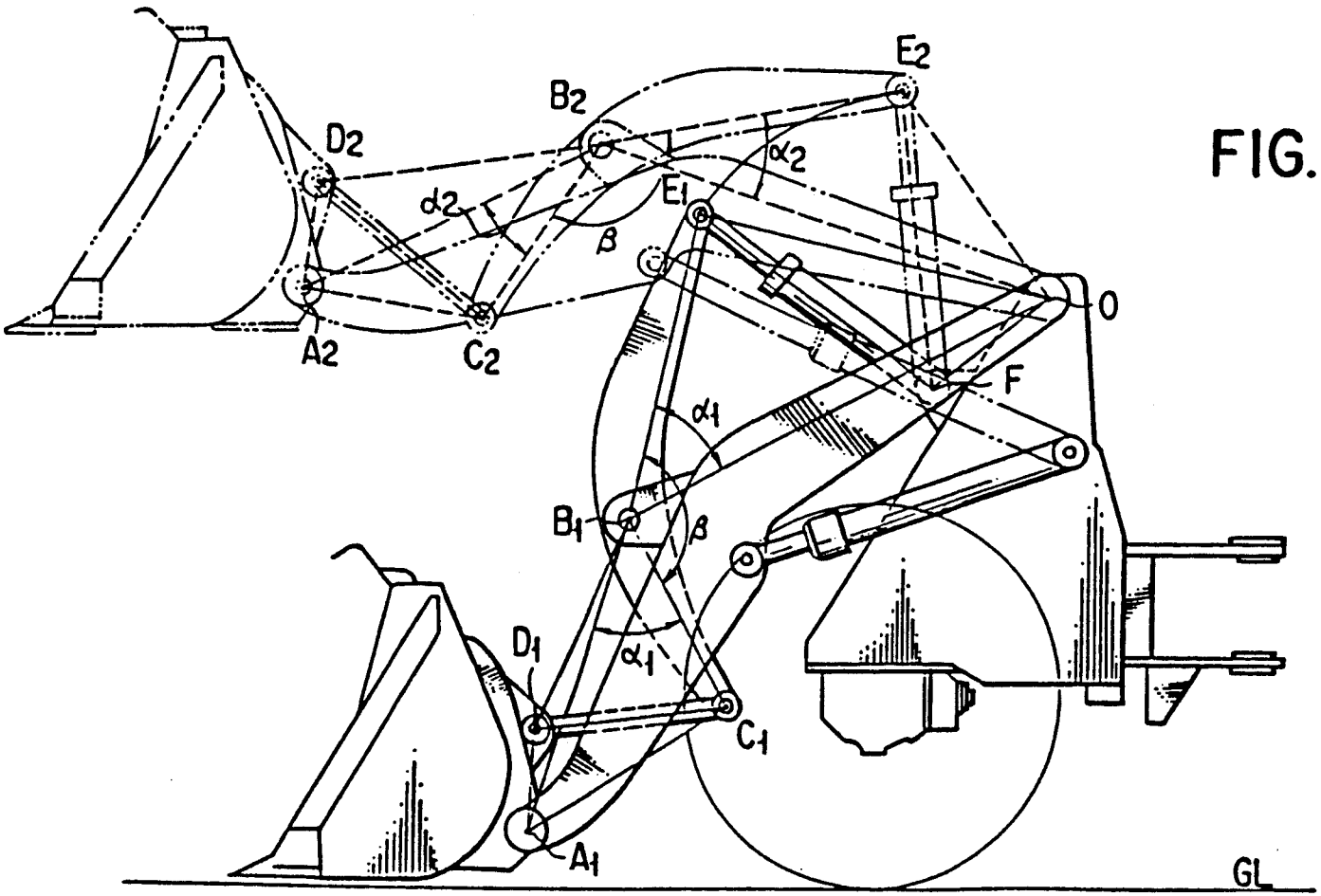
FIG. 3 is a diagrammatic view for explaining operations of the preferred embodiment illustrated in FIG. 2.

Now this will be proved with reference to FIG. 3.

Under the condition where the bucket is disposed and held in parallel to the ground surface (horizontal), $\Delta A_1B_1C_1$ $\Delta OB_1E_1$ (similar figure ratio $\alpha$)
$\Delta A_1D_1C_1$ $\Delta OFE_1$ (similar figure ratio $\alpha$).

Now, imagining the case where the lift arm has been rotated upwards (without operating the tilt cylinder), then the relations of:

$$\angle A_2B_2C_2 = \angle OB_2E_2 = \alpha_2$$

are always valid. Therefore, $$\Delta A_2B_2C_2 \quad \Delta OB_2E_2 \qquad (1)$$

$$\text{Hence, } A_2C_2 = \frac{1}{\alpha} OE_2 \qquad (2)$$

On the other hand, $$A_2D_2 = A_1D_1 = \frac{1}{\alpha} OF \qquad (3)$$

$$\text{and } D_2C_2 = D_1C_1 = \frac{1}{\alpha} FE_1 = \frac{1}{\alpha} FE_2 \qquad (4)$$

are always valid.

From (1), (2) and (3), $$\Delta A_2D_2C_2 \quad \Delta OEF_2 \qquad (5)$$

From (1) and (5), $$\text{quadrilateral } A_2C_2B_2D_2 \quad \text{quadrilateral } OE_2B_2F \qquad (6)$$

$$\text{Also, } \angle C_2B_2E_2 = \beta = \text{constant} \qquad (7)$$

(6) and (7) show that at any arbitrary lift arm position, two similar quadrilaterals are jointed at a point B with a constant angle $\beta$ formed therebetween.

Accordingly, a relative angle between a pair of corresponding edges of the two similar quadrilaterals, for instance, $\overline{AD}$ and $\overline{OF}$ is always constant ($\beta$) without depending upon the position of the lift arm.

$\overline{OF}$ is a segment fixed to the vehicle.

Therefore, $\overline{AD}$ has a constant angle with respect to the vehicle without depending upon a rotary angle of the lift arm. Accordingly, the bucket keeps its horizontal attitude even if the position of the lift arm changes.

Figure 4:
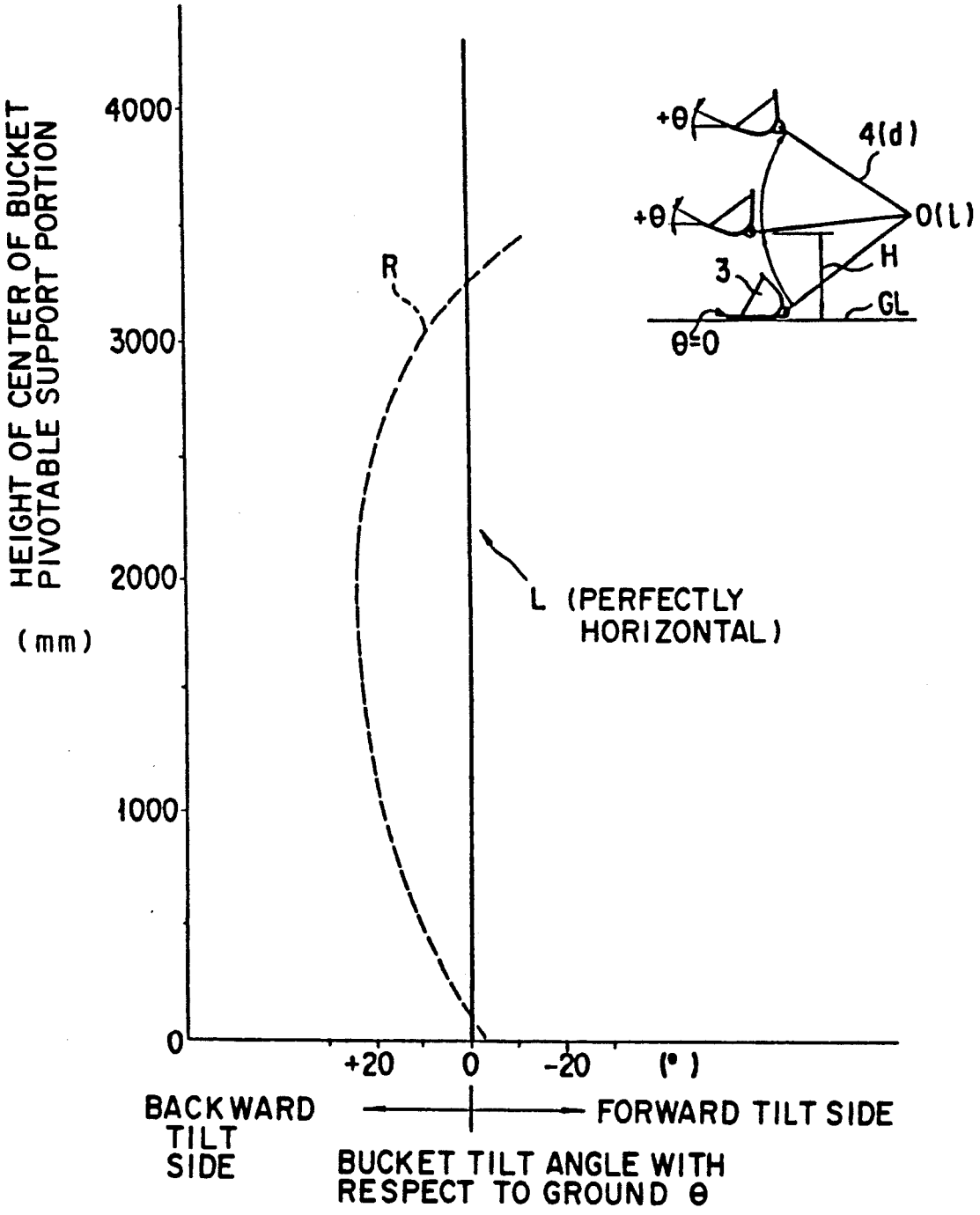
FIG. 4 is a diagram comparatively showing bucket tilt angle with respect to the ground in the preferred embodiment of the present invention and in the example of the prior art.

Also, a bucket tilt angle $\theta$ with respect to the ground of the bucket bottom surface 11 when the lift arm 4 is rotated up and down in this preferred embodiment, is shown by a straight line L in FIG. 4. As will be obvious from this figure, while the angle in the linkage mechanism in the prior art changes by about 20° at the maximum as shown by a curve R, it is seen that in the linkage mechanism according to the present invention, a perfectly horizontal operation is effected as shown by the straight line L.

We claim:

1. A linkage mechanism of a work implement in a loading vehicle comprising:

a lift arm having a support end pivotably supported from a vehicle body and a front end extending forward and rotatable up and down in a vertical direction about a first pivotal support point on the support end;

a bucket pivotally supported on a second pivotal support point located at a lower portion of a rear surface of said bucket and the front end portion of said lift arm;

a bellcrank pivotably supported from said lift arm on a third pivotal support point located at a middle portion along a longitudinal direction of said bellcrank;

a tilt rod pivotably connected at a fourth pivotal support point located at a forward end portion of said bellcrank and at a fifth pivotal support point located on an upper portion of the rear surface of said bucket; and a tilt cylinder pivotably connected at a sixth pivotal support point at the vehicle body and at a seventh pivotal support point on a rear end portion of said bellcrank to be operated for tilting said bucket wherein a distance from the second pivotable support point between said bucket and said lift arm to the third pivotable support point between said lift arm and said bellcrank is represented by X, and a distance from the third pivotable support point between said lift arm and said bellcrank to the first pivotable support point between said lift arm and the vehicle body is represented by Y, a ratio between the distances X and Y is set at $\alpha$ ($Y/X=\alpha$), and further wherein a first triangle is defined between the first pivotable support, the third pivotable support point and the seventh pivotable support point, a second triangle is defined between the second pivotable support point, the third pivotal support point and the fourth pivotable support point, a third triangle is defined between the first pivotable support point, the seventh pivotable support point and the sixth pivotable support point, and a fourth triangle is defined between the second pivotable support point, the fourth pivotable support point and the fifth pivotable support point such that the first and third triangles are in similar figure ratio relationships with the second and fourth triangles, respectively.

2. A linkage mechanism of a work implement as claimed in claim 1, wherein the similar figure ratio relationship of the first triangle with the second triangle and the third triangle with the fourth triangle is $\alpha$.

* * * * *